US005986202A

United States Patent [19]

Seiler

[11] Patent Number: 5,986,202

[45] Date of Patent: Nov. 16, 1999

[54] ELECTRONIC KEYBOARD INSTRUMENT

[75] Inventor: Steffen Seiler, late of Kitzingen, Germany, by Ursula Seiler, legal representative

[73] Assignee: Ed. Seiler Pianofortefabrik GmbH & Co. KG, Kitzingen-Hohenfeld, Germany

[21] Appl. No.: 09/120,936

[22] Filed: Jul. 22, 1998

[51] Int. Cl.[6] ..... G10C 3/12; G10C 3/16

[52] U.S. Cl. ..... 84/719; 84/18; 84/217; 84/218; 84/423 R; 84/720

[58] Field of Search ..... 84/2–3, 18–23, 84/217–218, 236–239, 255, 423 R, 433, 465, 467, 719, 720, 665, 741

[56] References Cited

U.S. PATENT DOCUMENTS

| | | | |
|---|---|---|---|
| 4,217,803 | 8/1980 | Dodds | 84/1.1 |
| 4,667,563 | 5/1987 | Wakuda et al. | 84/439 |
| 5,247,129 | 9/1993 | Nozaki et al. | 84/615 |
| 5,428,186 | 6/1995 | Kaneko et al. | 84/719 |
| 5,679,914 | 10/1997 | Niitsuma | 84/687 |

FOREIGN PATENT DOCUMENTS

| | | |
|---|---|---|
| 0206284 | 6/1986 | European Pat. Off. . |
| 0689183 | 6/1995 | European Pat. Off. . |
| 19644780 | 4/1997 | Germany . |
| 60-44665 | 10/1985 | Japan . |
| 2078426 | 1/1982 | United Kingdom . |

*Primary Examiner*—Robert E. Nappi
*Assistant Examiner*—Marlon T. Fletcher
*Attorney, Agent, or Firm*—Pandiscio & Pandiscio

[57] ABSTRACT

A silent electronic keyboard instrument for operation in conjunction with a synthesizer for transmitting sound only electronically to a headphone terminal, and exhibiting keyboard operation substantially duplicative of acoustic piano keyboard operation.

11 Claims, 1 Drawing Sheet

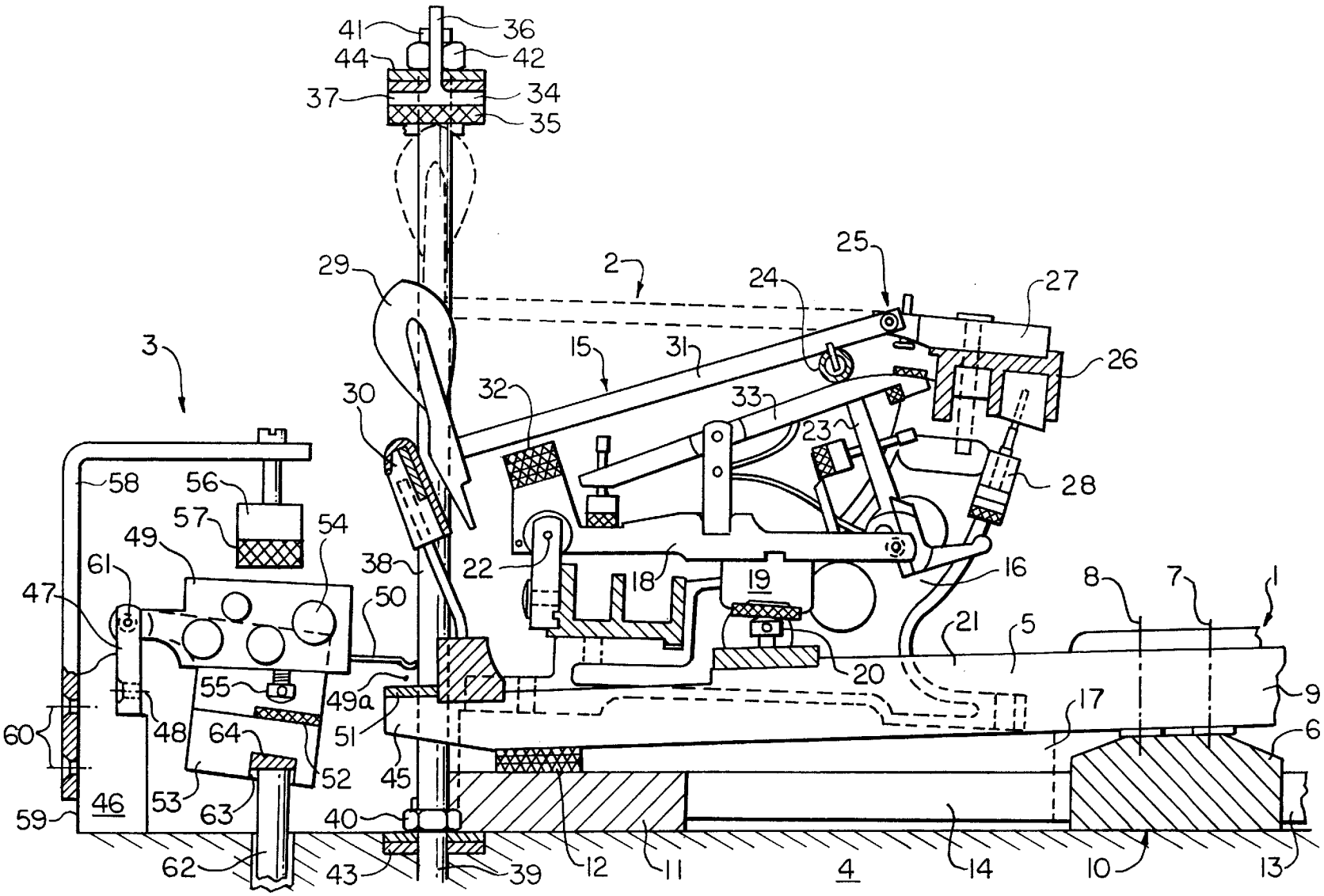

ELECTRONIC KEYBOARD INSTRUMENT

BACKGROUND OF THE INVENTION

1. Field of the Invention

The invention relates to an electronic keyboard instrument with a synthesizer, which imitates as realistically as possible the sound of a string instrument, in particular a grand piano, preferably as a silent practice instrument exclusively with a headphone socket.

2. Description of the Prior Art

Professional musicians, in particular pianists, must practice daily on their instruments, which particularly in flats with poorly soundproofed walls is even perceived as a disadvantage by neighbors who are music enthusiasts. Therefore, there has been a trend to provide for the pianist "electronic grand pianos" with a headphone socket, in order that he can do his practice with this otherwise silent instrument without annoying the neighbors. In purely "electronic grand pianos", which have neither strings nor a soundboard to generate the sound, the usual mechanism in conventional pianos is missing and is instead replaced with electric switches, or the like. This means that the pianist, upon pressing down a key perceives a completely different touch than in a conventional grand piano, which has an adverse effect on his practicing.

From U.S. Pat. No. 4,217,803, an electronic keyboard instrument is known in which on the upper face of a lifting member is a weight, which generates an inertia force when the keys are actuated, so that a touch corresponding to a piano key mechanism is supposed to be created. However, the lifting member lies on the tip of an impact tongue, which projects from the upper surface of the key end. Thereby, the inertia force of the weight is felt immediately from the beginning to the end of pressure on the key without any perceivable intermediate gradation.

From U.S. 4,667,553, likewise a lifting member with an additional weight rests on the upper face of a piano key. In addition, below the key front end, a resiliently deformable cup element is provided. If the key is pressed at first only two-thirds of the possible way down, only the weight on the lifting member and another weight on the key end have an effect. With further pressure until full depression of the key, the cup element has to be deformed by the under-side of the depressed keys, so that for the player, an additional pressure sensation is created which is supposed to approximate the natural touch of a piano action. However, this does not do justice to the typical effect of the damping mechanism of a piano or grand piano on the customary key touch. Against this, above all, is the resilience of the cup element.

The object of the invention is, in an electronic keyboard instrument for imitating the sound of a piano or grand piano, so to form the key mechanism that the usual touch of a grand or piano is not lost, but the behavior of the key when touched corresponds as closely as possible to the acoustic original.

SUMMARY OF THE INVENTION

To achieve this, in an electronic keyboard instrument having the features mentioned in the introduction, it is proposed that:

a) the damping simulator is formed like the damping mechanism of a piano or grand piano, b) wherein the damper pad and the damper tangents are omitted, and c) if the key is not depressed and the lifting member is lowered, an interstice or gap remains between them, which when overcome marks a tangible pressure point with increasing pressure on the key.

To create the normal touch for the pianist, therefore, the damping mechanism of a grand or upright piano, which would as such be superfluous in an electronic practice instrument with headphones, is authentically executed and adapted to requirements. Due to the space left open according to the invention, the pianist feels, for example, when the key is depressed half way, the mechanical variation of the key weight and therefore a typical, non-dispensable mechanical stop feature. The damper arm, which normally carries and moves the damper tangent with the damper pad, is changed according to the invention in that instead weights are disposed on the damper arm (lifting member) which correspond to the weight of damper tangents and damper pads.

This technology so rounds off the mechanical touch for the pianist that it can equal that of an original grand piano.

The invention alternatively, or additionally, proposes that, in order to solve the problem posed, the keys of the electronic instrument according to the invention are coupled to a respective original hammer, in particular grand piano action, wherein instead of the strings a bar is provided, against which a hammer impacts by pressing of the relevant key. By the use of a conventional action, its mechanical properties are also assumed, which in the keyboard instrument according to the invention used for practice purposes represent the purpose proper of the action. Thus, in a conventional grand piano action with rapid repetition of the notes, as the playing of trills requires, the impact tongue must each time have the opportunity of returning from the released state under the hammer rod roller in order to be able to impart to the hammer sufficient momentum for a repeated strike. The key return movement necessary for this can only be felt with the aid of an original action. On the other hand, for feeling of the repetition properties, in addition to the use of an original action, also a behavior approximately true to the original action of a hammer rebounding from the string is necessary. This can be achieved exclusively if the hammer with its hammer head is hurled against a bar which is located just where in conventional pianos the point of impact on the corresponding string lies only by this cooperation of an original action with a bar for simulating the rebounding of the hammer can such difficult passages as trills be practiced in a natural manner faithful to the original. As the hammer hit the rebound bar with its head, any bending of the hammer rod and stresses of the hammers coupling point are avoided, so that the action of the electronic keyboard instrument according to the invention has a long life expectancy.

It has been found advantageous if the impact and rebound bar according to the invention is fixed to the instrument housing with insulating material. As such insulating materials, in particular underfelt discs of a resilient material can be used, which allow the bar according to the invention to fall back resiliently in the case of impact, similarly to an original string, and at the same time store the kinetic energy of the hammer temporarily a potential energy, and after reversal of the direction of motion of the hammer, impart the energy thereto so that the rebound effect is maximal.

It is further provided that the bar is damped at the point of impact of the hammers. Thus, any noise development can be avoided. To this end, also a construction according to the invention is provided, wherein the hammer head has the form corresponding to an original hammer. in particular grand piano action, and is covered with an impact-damping layer. For this, on the one hand an original hammer head felt can be used. Due to the stop face extending over the entire width of the hammer head, the maximum pressure exerted on the felt is significantly lower than in an original string tension, so that other coverings can be used as trimming, particularly if the stop and rebound bar according to the invention is additionally damped. Bar damping and/or hammer head trimming can also be resiliently formed.

If, with the action according to the invention cooperating with a hammer rebound bar, the rapid repetition of individual notes and, in particular, the key stroke necessary therefor can be practised faithfully to the original, for exact simulation of the force necessary for key actuation in acoustic pianos additional secondary effects must be taken into account. This includes, in particular, the damping mechanism of an acoustic piano, since this is likewise actuated by the relevant key and for this requires additional force.

The invention proposes to this end that the keys of a generic instrument are coupled to a respective damping simulator, which feels like the damping mechanism of a piano, wherein the damper pads and the damper tangents are omitted and instead on an upwardly pivotable lifting member one or more additional weights are provided. In the absence of a string, the damper mechanism is also superfluous in a purely electronic keyboard instrument. On the other hand, conventional damper pads have a weight in the order of 20 g, and this weight with the damper pad lifted stresses the respective key via the damper spoon resting on the keyboard. Therefore, after a specified key position, in which the damper spoon rests on the keyboard material, the actuating force needed for further pivoting of the key increases. The pianist then detects an additional pressure point which may give him additional data about the key position. This pressure point is therefore very important for realistic practice and is simulated according to the invention by a weight-loaded lifting member. This lifting member has, similarly to a damper lifting member usual to an acoustic piano, an elongate shape approximately parallel to the respective key and is coupled at its end face remote from the keyboard to a lifting member capsule, which is in turn screwed to a transverse bar. On the front end face of the lifting member according to the invention, similarly to the damper spoon in the damping mechanism of an acoustic grand piano, a spoon projects which extends to above the key covered with the keyboard material Instead of the spoon, a nozzle directly formed on the lifting member may be present. As the lifting member rests in the lowered position on a support bar, between the spoon or nozzle and the respective key is a gap, which makes the pressure point perceivable in acoustic pianos, from which the damping mechanism additionally stresses the key. This pressure point of the lifting member according to the invention can, if necessary, be displaced by a displaceble dolly between the underside of the lifting member and the upper face of the support bar.

To receive the additional weight(s), it is proposed according to the invention that the lifting member is formed thickened in its upward extension with respect to a conventional damping member and has cut-outs with weights inserted. Since the width of a lifting member according to the invention is determined by the key width, the invention gains in the vertical direction space for the additional weights and thereby makes it possible to assume the length of the lifting member according to the invention and therefore the distance of the spoon from the coupling point of an original damper lifting member, so that the usual torque characteristic is retained.

An advantageous development of the invention is achieved in that one of the additional weights in the vicinity of the damper spoon or nozzle is disposed where in a conventional damping lifting member the coupling point of the plunger capsule carrying the damper tangents is located. At this point, the additional weight generates approximately the same torque as the damper pad stressing this point in a conventional damper mechanism.

In order to simulate as realistically as possible the additional stress for key movement brought about by a conventional damping mechanism the additional weight(s) should correspond approximately to the weight of the damper pad, damper tangent and plunger capsule. The total weight of these elements lies conventionally in the order of approx. 15 g to 20 g. Such a weight can be produced e,g. by the insertion of a lead rivet.

The keyboard instrument according to the invention can be further optimised if the additional weight(s) of the usually heavier damping of deeper strings is/are correspondingly larger in the middle register than in the descant and larger in the bass than in the middle register. In order to achieve sufficient damping of the thicker strings in the middle register, in these registers in acoustic grand pianos the weight of the damping mechanism stressing the string is increased. This step should be simulated by different sizes of additional weights.

The invention is further characterised in that above the lifting member a rebound bar for intercepting the same is provided. Thereby, excessive springing up of the lifting member in the case of a strong key impact is avoided, and the lifting member spoon returns immediately to the key.

Finally, it is according to the teaching of the patent that a lifting rod extending transverse to the key longitudinal direction is provided below the lifting member and may be lifted via a thruster coupled to the forte pedal and at the same time pivots the lifting member out of the region of the key movement. Preferably, as a lifting rod, the support bar necessary for the lifting member in the invention can be used, unlike conventional damping mechanisms of acoustic pianos in that the support bar is disposed pivotably about its axis parallel to its longitudinal direction, Preferably, this pivotal axis is coaxial to the pivotal axis of the lifting members, wherein two coupling points are located laterally outside the two outermost damping capsules. This has the advantage that the lifting rod, upon actuation of the forte pedal, does not change with respect to the lifting members preferably pivoting up to the rebound bar according to the invention, and therefore generates neither friction nor noise. Actuation of the lifting rod can, as in an original damping mechanism, be effected by a vertically upwardly oriented thruster, which to this end engages in a recess in the lifting rod lined with felt.

BRIEF DESCRIPTION OF THE DRAWINGS

Further features, details and advantages on the basis of the invention will appear from the following description of a preferred embodiment of the invention and with the aid of the drawing. Its only FIGURE shows a side view of the action of an electronic keyboard instrument according to the invention.

DESCRIPTION OF THE PREFERRED EMBODIMENT

The keyboard instrument according to the invention consists of a housing, with legs for the keyboard 1, action 2, damping simulator 3 and an electronic assembly (not shown in the drawing) for generating electronic signals which are made audible via a headphone set for the pianist, also not shown. The base 4 of the housing has a rectangular surface whose dimensions are determined by the length of the keyboard on the one hand and the length of a key 5 together with the depth of the damping simulator 3. This housing base 4 is formed as a carrying chassis and rests on four legs. In the region of the rear edge of the housing chassis 4 is a lyre, in whose lyre box a forte and a piano pedal are mounted.

The keys 5 are mounted on a balance arm 6 fixed on the housing chassis 4 and extending in the longitudinal direction of the keyboard 1, with balance arm pins 7 for the white keys and balance arm pins 8 for the black keys. The actuation position and the speed of the keys 5 is registered by optoelectronic sensors, which are located in the region of the front keys 9 not shown.

The balance arm 6 is a component of the keyboard frame 10, which furthermore consists of a frame front piece (not shown) defining the depth of touch of the front keys and a frame rear piece 11 which by means of an adhered cushion strip 12 acts as a stop element for limiting the key motion in its raised position. Frame front piece and frame rear piece 11 are fixed by frame outer transverse pieces 13, 14 to the two end faces of the keyboard 1 and by parallel frame middle transverse pieces relative to the balance arm 6.

Each key 5 of the keyboard according to the invention cooperates with the action 2, which, similar to the action of an acoustic grand piano, has a hammer 15. The moving parts of the action 2 are mounted on bars or rotary shafts which are supported by action checks 16, which are fixed via spacer blocks 17 to the housing base 4.

Each action 2 has an elongate lifting member 18 with a lifting saddle 19, which is disposed approximately centrally on its under-side and which cooperates with a metal screw 20 on the upper face of the rear of key 21 and upon lifting thereof pivots the lifting member 18 upward about a shaft 22 located on its back end. in this case, the approximate vertical shank of a thrust tongue 23 coupled to the front end of the lifting member 18 presses against a hammer rod roller 24 and thus pivots the hammer 15 about its coupling point 25 on a hammer rod capsule 27 screwed to an action beam 26 upwards. In a specified rotary position of the lifting member 18, the horizontal arm of the thrust tongue 23 hits a release dolly 28 and pivots the vertical impact tongue arm away from the hammer rod roller 24, so that the hammer 15 is now hurled freely upward.

In its subsequent falling movement, a hammer head 29 is intercepted by a check 30 connected to the rear portion of the key 21, until a hammer shaft 31 is gently laid on a hammer resting bar 32 covered with felt. In the case of rapid repeating, however, the hammer 15 does not return to its starting position but is caught in a central position by a repeat shank 33 on the hammer rod roller 24 extending approximately in the key longitudinal direction and coupled to the lifting member 18 approximately centrally, in order that the vertical shank of the thrust tongue 23 has a chance to position itself once again below the hammer rod roller 24 and is therefore ready for renewed impact by the key 5.

For the practice of such rapidly consecutive impacts, it is necessary that also the rebound speed of the hammer 15 approximately corresponds to the hammer speed of an acoustic piano. To this end, at the level of the stringing usual in acoustic pianos above the hammer head 29 a stop and rebound bar 34 for the hammer heads 29 of all actions is provided above the hammer head 29 and extending in the longitudinal direction of the keyboard 1.

The bar 34 consists of a T-profile standing on its head and is covered on its under-side with a damping material, e.g. of felt, or a resilient material. A vertical flange 36 of the T-profile is remote at the ends of the stop and rebound bar 34 and at further central fixing points. A horizontal flange 37 of the T-profile is bored through at these points and receives a vertical bolt 38 which is screwed tightly 40 in a corresponding bore 39 of the housing base 4. The stop and rebound bar 34 is screwed tightly at the upper ends 41 of the bolts 38 to upper and lower threaded elements 42, 43. In order to suppress any transmission of vibrations from the stop and rebound bar 34 via the bolts 38 to the housing base 4, between the threaded elements 40, 42, 43 and the housing base on the one end both the stop and rebound bar 34 and at the other end isolation elements 43, 44 in the form of resilient underlay discs are provided.

After the hammer 15 has shot up, its head 29 provided with a conventional covering hits damping material 35 on the under-side of the stop and rebound bar 34, and the kinetic energy of the hammer 15 is temporarily converted into a resilient deforming of the covering of the hammer head 29, the damping material 35 and the resilient underlay discs 43, 44. In the consequent downward movement of the hammer 15, these elements are released again and thereby yield their energy in the opposite direction to the hammer 15, which is thereby accelerated similar to the resilient deformation of conventional strings, and moves downward according to the conventional rebound speed. The pianist can therefore establish precisely how far the front portion of the key 9 has to be lifted and how long it has to wait with a renewed impact in order that the vertical flange of the thrust tongue 23 has enough time to place itself under the hammer rod roller 24 of the hammer intercepted by the repeat shank 33. If the parameters do not harmonise, the pianist feels from the lack of resistance of the front portion of the key 9 that the action 2 has not been able to follow his movements.

In order to simulate the playing behavior of an acoustic grand piano in a realistic way, in the region of the key rear end 45 a device 3 for simulating the effect of the damping mechanism of acoustic grand pianos is provided. On a bar 46 extending parallel to the keyboard, upwardly oriented capsules 47 are screwed, to whose upper end a respective lifting member 49 is pivotably coupled. The lifting member 49 extends horizontally up to just in front of the key end 45 and continues in the form of a spoon 50 which projects therefrom to above the key end 45 with clearance 49*a* therefrom, and which can be raised therefrom with the interposition of a felt 51. If, on the other hand, the rear part of the key 21 is lowered, the lifting member 49 also pivots down until it rests on a support bar 53 covered with felt 52.

In the embodiment shown, the lifting member 49 carries weights in the form of four lead rivets 54, which for the descant form a total weight of 16 g, for the middle register a weight of 18 g, and for the bass register a weight of 24 g, which corresponds to the weight of damper pads and tangents as well as if necessary damping increasing elements in the middle and low registers of conventional grand pianos. If the front of key 9 is depressed, the rear portion 21 lifts until the key end 45 engages under the spoon 50 and then has to lift the weight-loaded lifting member 49. The pianist feels at this point a pressure point, where for further depression of the key 5 an additional force of the order of approx. 20 g is to be overcome. Since between the spoon 50 of the lifting member 49 and the feet 51 there is a clearance 49*a* of a few millimeters, the pressure point lies in a central position of the key 5 and can therefore transmit to the pianist information about the corresponding position of the action 2. In order to be able to displace this pressure point within certain limits, on the under-side of the lifting member 49 a regulating screw 55 is screwed in, with which the minimal clearance from the support bar 53 can be set.

Above the lifting member 49 extends an impact bar 56 which is covered on its under-side with a damping material 57 in the form of a felt. To fix the impact bar 56, metal brackets 58 disposed at regular intervals are provided, which at first extend horizontally as far as the rear of the capsule fixing face of bar 46 and from there roughly horizontally downward up to its rear face 59 and are there screwed into place by means of two screws 60.

In order to simulate a effect of the forte pedal, the support bar 53 is coupled pivotably about an axis which is coaxial to the pivotal axis 61 of a lifting member 49. It can be raised from a low position shown in the drawing by the thruster 62 of the forte pedal, which is to this end engaged in a recess 63 on the under-side of the support/lifting bar 53. To prevent noise, the base of the recess 63 is lined with a damping felt 64. Upon actuation of the forte pedal, the thruster 62 presses the support bar 53 and therewith the lifting members 49 supported thereon with regulating screws 55 against the damping material 57 of the impact bar 56, so that all the spoons 50 are removed from the moving region of the keys 5 and then, as in acoustic grand pianos, the additional pressure point of the damping simulator 3 becomes superfluous.

I claim:

1. A silent electronic keyboard instrument for operation in conjunction with a synthesizer for transmitting sound only electronically to a head phone terminal, and exhibiting keyboard operation substantially duplicative of acoustic piano keyboard operation, said silent electronic keyboard instrument comprising:

a plurality of keys, each of said keys being disposed on a keyboard;

a plurality of damping simulators, each of said damping simulators being spaced from and disposed proximate a distal end of one of said keys and being disposed for engagement by said one of said keys upon operation of said one key, to dampen movement of said one key simulative of effects of damping mechanisms in acoustic pianos, each of said damping simulators being provided with a damper lifting member adapted to be moved upwardly by engagement of the one key with the damper lifting member, each of said damper lifting members being provided with a spoon portion extending therefrom and at a free end thereof overlying the distal end of said one of said keys and defining therewith a gap therebetween when said key is not in operation; and at least one weight fixed to said damper lifting member;

wherein upon operation of said key, said distal end of said key moves to close the gap and engage said spoon portion, said spoon portion, a remainder of said damper lifting member, and said weight being operative to exercise a resistive pressure on said key.

2. Keyboard instrument according to claim 1, wherein each of said damper lifting members is formed with at least one cut-out for receiving and retaining at least one of said weights.

3. Keyboard instrument according to claim 2, wherein said at least one weight is disposed proximate said spoon portion.

4. Keyboard instrument according to claim 1, wherein said at least one weight a substantially corresponds to a weight of a damper pad, a damper tangent and/or a plunger capsule of an acoustic piano.

5. Keyboard instrument according to claim 1 wherein said lifting member an impact bar is disposed for intercepting said lifting member.

6. Keyboard instrument according to claim 5, wherein below the lifting member a support bar is disposed, which extends transverse to the key longitudinal direction and which can be raised via a thruster coupled to a forte pedal for pivoting said lifting member out of range of key movement.

7. Keyboard instrument according to claim 6, wherein on an under-side of said lifting member a regulating screw is disposed, with which a distance of the lifting member from a support bar therebeneath can be set.

8. Keyboard instrument according to claim 1 wherein each of the keys is coupled to a hammer, and wherein a bar is provided, against which said hammer is hurled by pressing of a relevant one of said keys.

9. Keyboard instrument according to claim 8, wherein the bar is damped at an impact point of the hammer.

10. Keyboard instrument according to claim 8, wherein said hammer has a conventional piano hammer configuration and is covered with an impact-damping covering.

11. A silent electronic keyboard instrument for operation in conjunction with a synthesizer for transmitting sound only electronically to a head phone terminal, and exhibiting keyboard operation substantially duplicative of acoustic piano keyboard operation, said silent electronic keyboard instrument comprising:

a plurality of keys, each of said keys being disposed on a keyboard;

a plurality of damping simulators, each of said damping simulators being spaced from and disposed proximate a distal end of one of said keys and being disposed for engagement by said one of said keys upon operation of said one key, to dampen movement of said one key simulative of effects of damping mechanisms in acoustic pianos, each of said damping simulators being provided with a damper lifting member adapted to be moved upwardly by engagement of the one key with the damper lifting member, each of said damper lifting members being provided with a spoon portion extending therefrom and at a free end thereof overlying the distal end of said one of said keys and defining therewith a gap therebetween when said key is not in operation;

at least one weight fixed to said damper lifting member;

a support bar disposed below said lifting member; and a thruster for transmitting motion from a forte pedal to said support bar for moving said support bar and said lifting member so as to move said spoon portion beyond reach of said key distal end;

wherein upon operation of said key, said distal end of said key moves to close the gap and engage said spoon portion, said spoon portion, a remainder of said damper lifting member, and said weight being operative to exercise a resistive pressure on said key; and wherein upon activation of the forte pedal the spoon portion is moved to a position out of contact with said key distal end.

* * * * *

UNITED STATES PATENT AND TRADEMARK OFFICE

CERTIFICATE OF CORRECTION

PATENT NO. : 5,986,202

DATED : November 16, 1999

INVENTOR(S) : Steffen Seiler

It is certified that error appears in the above-indentified patent and that said Letters Patent is hereby corrected as shown below:

Claim 4, column 7, last line, delete "a"; (1st occur.)

Claim 5, column 8, line 3, insert "above" after -- wherein --.

Signed and Sealed this

Twelfth Day of December, 2000

*Attest:*

Q. TODD DICKINSON

*Attesting Officer*

*Director of Patents and Trademarks*